US005690248A

United States Patent [19]

Hulls

[11] Patent Number: 5,690,248

[45] Date of Patent: Nov. 25, 1997

[54] BAG ASSEMBLY FOR RECYCLING

[75] Inventor: John R. Hulls, Point Reyes, Calif.

[73] Assignee: Altamont, Inc., Key Biscayne, Fla.

[21] Appl. No.: 787,040

[22] Filed: Jan. 27, 1997

Related U.S. Application Data

[63] Continuation of Ser. No. 344,817, Nov. 23, 1994, abandoned.

[51] Int. Cl.[6] ..... B65D 33/01; B65D 90/04

[52] U.S. Cl. ..... 220/404; 383/2; 383/101; 383/103; 383/120

[58] Field of Search ..... 383/2, 120, 45, 383/101, 103; 220/404

[56] References Cited

U.S. PATENT DOCUMENTS

| | | | |
|---|---|---|---|
| 426,774 | 4/1890 | Claussen | 383/120 |
| 883,797 | 4/1908 | Geldmacher | 383/2 |
| 908,380 | 12/1908 | Benner | 383/120 |
| 1,092,868 | 4/1914 | Smith | 383/120 |
| 1,484,606 | 2/1924 | Hanford | 220/404 |
| 1,767,274 | 6/1930 | Broderick | 383/2 |
| 1,902,368 | 3/1933 | Johns | 383/120 |
| 1,907,082 | 5/1933 | Meltzer | 220/404 |
| 2,318,952 | 5/1943 | Martin | 220/404 |
| 2,628,764 | 2/1953 | Rubinstein et al. | 383/120 |
| 2,952,381 | 9/1960 | Rosner | 383/2 |
| 2,980,314 | 4/1961 | Adams . | |
| 3,294,312 | 12/1966 | Mullins | 383/2 |
| 3,305,160 | 2/1967 | Lehman | 383/2 |
| 3,349,991 | 10/1967 | Kessler . | |
| 3,628,720 | 12/1971 | Schmedding | 383/103 |
| 3,756,144 | 9/1973 | Engebretsen | 100/229 A |
| 3,827,352 | 8/1974 | Stratman et al. | 100/229 A |
| 4,096,987 | 6/1978 | Rodish | 383/2 |
| 4,747,701 | 5/1988 | Perkins . | |
| 4,913,560 | 4/1990 | Herrington . | |
| 4,953,704 | 9/1990 | Cortese . | |
| 4,978,231 | 12/1990 | Ling et al. . | |
| 4,989,994 | 2/1991 | Gelbard . | |
| 5,028,022 | 7/1991 | Metcalf . | |
| 5,040,902 | 8/1991 | Eaton et al. . | |
| 5,133,607 | 7/1992 | Bonke . | |

FOREIGN PATENT DOCUMENTS

| | | | |
|---|---|---|---|
| 859428 | 12/1952 | Germany | 383/120 |
| 54311 | 4/1943 | Netherlands | 383/120 |
| 2226541 | 7/1990 | United Kingdom | 383/120 |

*Primary Examiner*—Stephen P. Garbe
*Attorney, Agent, or Firm*—Majestic, Parsons, Siebert & Hsue

[57] ABSTRACT

A bag assembly for containing material requiring handling and compaction, such as household waste products, is provided that includes bags that are nested one within another to produce a double-walled structure. Gussets and folds are also provided which are temporarily held together by restraining means such as adhesive to provide a first, smaller bag volume for a waste container. A bag restraining lid is removably positionable over the open end of the container, which includes a container lid thereon for accessing the bag assembly. The adhesive is adapted to break away when the bag assembly is compacted so that it assumes a second, larger volume and thereby minimizes the chance that the bag assembly will be ruptured during the compaction process. In an alternate embodiment, the bag assembly may be supported by a rack, frame, or hook. In a still further embodiment, the bag assembly may be a single-walled rather than a double-walled structure.

22 Claims, 3 Drawing Sheets

BAG ASSEMBLY FOR RECYCLING

This is a continuation of application Ser. No. 08/344,817 filed Nov. 23, 1994, now abandoned.

BACKGROUND OF THE INVENTION

Currently, recycling programs are being politically mandated as environmentally sound. Much recyclable waste, such as household waste products, is being collected. Some comes from single-family homes. Other waste, a significant amount of about forty-two percent, is being generated in high-rise buildings.

The most basic form of recycling involves separation of recyclables from non-recyclables at a transfer station. Recyclables may be metal, glass, plastic, paper, or other materials that can be reused. Typically, the homeowner or high-rise dweller just throws the recyclables mixed with other organic material, etc. in a garbage can or chute (high-rise). The contents of the garbage can are then loaded into a garbage truck, usually with compaction capability. In the high-rise building, the garbage may be collected in large bins, which are then loaded into the compaction truck. The compacted waste, including both recyclables and non-recyclables, is then transported to a transfer station.

At the transfer station, the trucks are unloaded and the waste, including recyclables, is spread out for sorting. By various means, the recyclables are removed, categorized, and placed into intermediate storage areas or bins. For example, aluminum, which is currently in the greatest demand, is placed in one storage location. Other metals are placed in another. Glass is placed in another, and plastic is placed in yet another. Paper is placed in another. What remains of the waste after removal of recyclables is then loaded onto transfer vehicles such as on-highway trucks for transport to landfill facilities. Alternatively, trains may be used to transport the waste where longer distances to the landfill are involved.

A problem with the just-described system is that the recyclables are contaminated by the other components of the raw garbage. This may lower the value of the recyclables, as some must be discarded, and others cleaned prior to re-use.

Another problem is that of high cost. This cost is both in terms of labor and equipment. Complex equipment is needed to sort the recyclables from the rest of the waste. Such equipment may include electromagnetic means for separating the ferrous metal from non-ferrous metal, such as aluminum. Regardless of the amount of equipment used, expensive hand labor ultimately must be resorted to for a portion of the recyclables.

Still another problem is that of the working environment for the hand labor. At the very best, it is unpleasant. At worst, it can be hazardous to worker health and well-being.

In an attempt to ameliorate some of these problems, advances in recycling have been made. One such advance is the so-called "Blue Bag" program that has been used in Pittsburgh and other United States East Coast cities. With this system, the consumer places the recyclables in a separate plastic bag of a blue color. The bags are very thick and the recyclables can only be compacted to about a 2:1 ratio as opposed to about 6:1 that can be achieved with conventional garbage compaction trucks. This system has a cost disadvantage, since more trucks or runs are needed for pickup than with other systems. Also, it is easy for operators to overcompact, which results in breaking of the bags and consequent undesired mixing of the contents with the raw garbage, thus destroying or substantially reducing its value as a recyclable.

Another such advance is to provide the consumer with several containers in addition to the normal garbage can or bin so that the customer may do the initial separation and classification of the recyclables. One such system provides three stacking box containers of plastic material. These are for: (1) aluminum and plastic; (2) glass; and (3) paper (e.g., newspaper). With this system, a special collection truck having three bins on a side follows after the normal garbage truck. The individual boxes are hand dumped into the appropriate bin on the side of the recyclable collection truck, and the truck driven to a transfer station where it is unloaded into appropriate storage bins or areas as with the previous system.

This advanced system, which is coming into increasing use, has its problems. It is still costly. Now a second truck is required, which essentially doubles the vehicles and personnel required for collection from the customer.

It is also inefficient in that many recyclable collection trucks do not have compactor capability. Thus, recyclable trucks are less densely loaded than normal garbage compactor vehicles.

It may also be less convenient to the customer where the boxes are required to be taken out to the curb rather than being picked up at the side or back of the customer's house, as with some waste pickup systems. As with anything placed at the curb, the boxes may invite theft or vandalism. Theft of the valuable recyclables, such as aluminum, can severely negatively impact the economics of recycling programs. The initial negative economic impact is on the collection company. This later transfers through to the customer in that the loss is reflected in higher garbage collection bills.

Aesthetically, the boxes at the curb are considered unsightly by some. They must also be placed at the curb on the appropriate day and retrieved after the collection truck has passed. If the homeowner plans to be away, the boxes may have to be put out a day or more early, or the pickup simply missed. If missed, more than one collection period worth of recyclables will have to be stored by the customer until the next pickup. All of these problems make the customer less likely to be a willing participant in recycling.

Still another problem being encountered with any recycling system is selling the collected recyclables. There may, in fact, be no spot market for certain recyclables at a given time. Or the spot market price may be too low to be economic. This gives rise to the need to be able to store classified recyclables until the market can recover to where selling the recyclables makes economic sense.

Another problem is the need to be able to collect and store a sufficient quantity of recyclables to make it economically worthwhile to build necessary reclamation plants. With plastic, for example, it is currently desirable to have up to four year's worth of recycled plastic on hand to make it worthwhile to build such a plant. Obviously, this necessitates a great deal of storage space. Still another problem is being able to identify the classified recycled material so that automated equipment can be used in processing.

A solution to the above-described problems is the subject of co-pending U.S. patent application Ser. No. 08/344,814 filed Nov. 23, 1994, now U.S. Pat. No. 5,628,412. That application describes and claims a method of waste recycling which employs a plurality of bags for containing and transporting recyclables. The method broadly comprises the steps of: compacting recyclables that have been segregated into bags; transporting the bags to a transfer station; and separating the bags into groups of material containing like classifications.

A critical requirement of this method is that the bags be able to survive the compaction process relatively intact so that the recyclables contained therein are not contaminated by raw garbage or mixed with recyclables of other classifications. If the former, expensive cleaning may have to be done or the recyclables may simply be unusable. If the latter, the mixed recyclables will have to be again separated at the transfer station, thus requiring unwanted cost and time.

SUMMARY OF THE INVENTION

The present invention takes the form of a bag assembly that is able to sufficiently survive the compaction process above described. The bag assembly may be double-walled, which provides added strength over that found with single-walled bags. Because it is of a plastic material, a certain amount of elongation or stretching is possible without rupture as with conventional bags. Beyond this, however, is the provision of gussets between side panels and folds at the bottom that allow the bag assembly and its interior volume to be expanded without rupture of the walls. The gussets and folds are temporarily held together by retention means such as adhesive to effectively produce a smaller volume bag assembly. This smaller volume bag assembly may be of a suitable first, predetermined volume to fit within a garbage or waste container or can, with its open end folded over the rim of the container or can. Alternatively, the bag may be suspended from a rack, frame or hook rather than being placed within a container or can.

During compaction and the relatively large forces engendered, the retention means such as adhesive will break away. This will allow the gussets and/or folds to open up, thus effectively increasing the bag assembly volume to a larger, second predetermined volume. With this larger volume containing the recyclables, the chances of rupture of the bag assembly will be minimized.

As another feature of the invention, the bag assembly may be secured in this position by means of an elastic band that fits within an annular recess around the open end of the waste container or can. A tag may be secured to the elastic band which may bear indicia or be color-coded for purposes of identifying the contents of the bag assembly.

Alternatively, the bag assembly itself may be colored as a code, or bear indicia. The indicia in either case may be that which is visually readable or machine readable by a scanner. Examples of the latter are bar codes or magnetic coding which may be electronically scanned by means of a scanner or reader.

Still another feature of the inventive bag assembly is providing non-aligned holes in the double bag so that trapped air may escape during the compaction process and thereby avoid rupture or blowout of the bag assembly walls. By providing holes randomly distributed and of sufficiently small size over the top portion of the bag assembly, any fluid that leaks out of the garbage placed in the bag assembly when it is in its garbage container or can will not leak out of the bag assembly itself and into the container or can. The holes may be of any desirable shape or size. For example, in a preferred embodiment, they may be pinholes. Alternatively, they may be slots or slits. The holes may be distributed over the entire bag rather than just over the top portion. In a still further embodiment, the bag may be simply weakened, as by making the walls thinner at a number of points. Air pressure buildup in the bag during compaction will cause the formation of holes at the weakened spots.

It should be noted that while the inventive bag is talked about in connection with applicant's co-pending inventive method utilizing a plurality of bag containers, it could also be used with single bag systems. This would enhance the capability of single bag systems.

DETAILED DESCRIPTION OF THE PREFERRED EMBODIMENT

Figure 1:
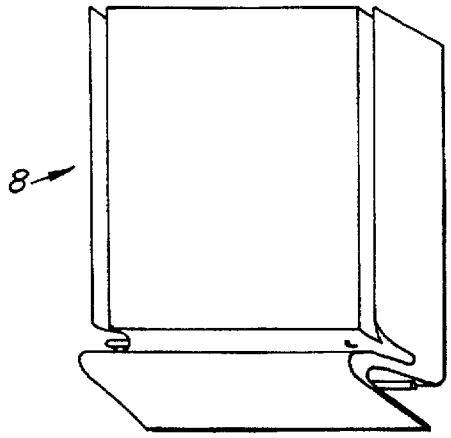
FIG. 1 is a top quarter isometric view of a preferred embodiment of the inventive bag assembly with folds and gussets expanded to show constructional features thereof.
Figure 4:
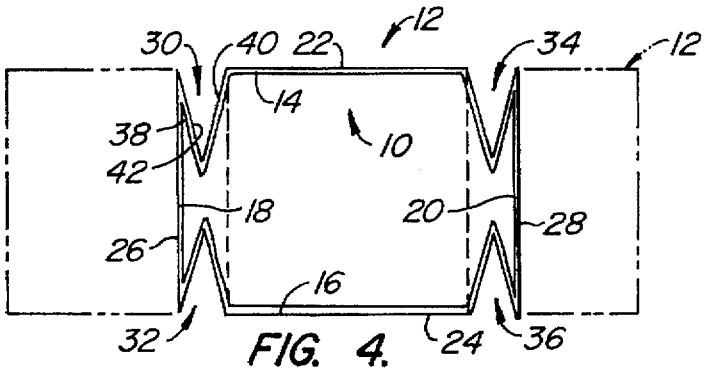
FIG. 4 is a view of the same.
Figure 2:
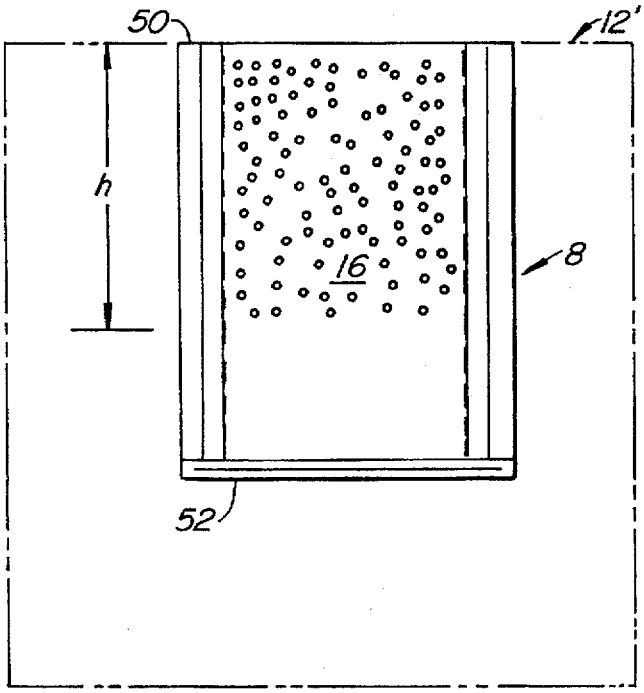
FIG. 2 is a front elevational view of the same.
Figure 3:
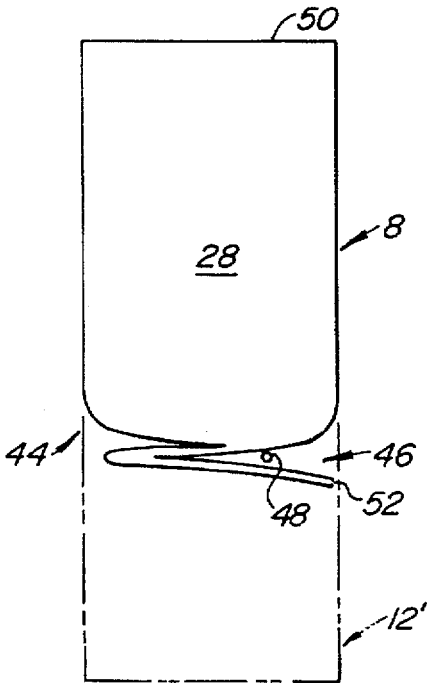
FIG. 3 is a right side elevation view of the same.

FIG. 1 shows a preferred embodiment of the inventive bag assembly shown generally at 8, with the folds and gussets expanded to show constructional features thereof. As best seen in FIGS. 2–4, the bag assembly comprises an inner bag 10 and an outer bag 12 which are closely nested, one inside the other. The two bags may be of plastic material such as polyethleyene, polyurethane, or other suitable film material. Each bag may be tubular in shape, having an open end and a closed end, as will be more fully described hereinafter. Each tubular bag may be folded into at least one main generally rectangular panel. In the figure, inner bag 10 is comprised of a pair of opposite side panels 14, 16 and a pair of opposite end panels 18, 20. Similarly, outer bag 12 is comprised of a pair of opposite side panels 22, 24, and a pair of opposite end panels 26, 28.

Each bag has four gussets or folds 30, 32, 34, and 36. Each gusset, in turn, is comprised of a pair of gusset panels which are normally held in contacting relation. By way of example, gusset 30 is made up of a pair of generally rectangular gusset panels 38, 40 of outer bag 12. Normally retaining the gusset 30 in a closed position with gusset panels 38 and 40 in contacting relation are dots or spots of adhesive, one of which is represented by dot 42, which are spaced over the area of contact between the gusset panels. The adhesive may be any suitable material which has a lower yield strength than that of the bag material itself, such as commonly-available hot melt adhesive.

Similarly, the bottom of the bag may be folded over into one or a number of folds such as the two folds 44, 46 shown in FIG. 3. Between each fold are dots of adhesive material, for example, at 48 in like manner to that found with the gussets previously described, and for the same purpose. The common purpose is so that the bag assembly may contain a first, smaller volume from its open end 50 to its closed end 52. Closed end 52 may be conveniently sealed by heat sealing.

Figure 5:
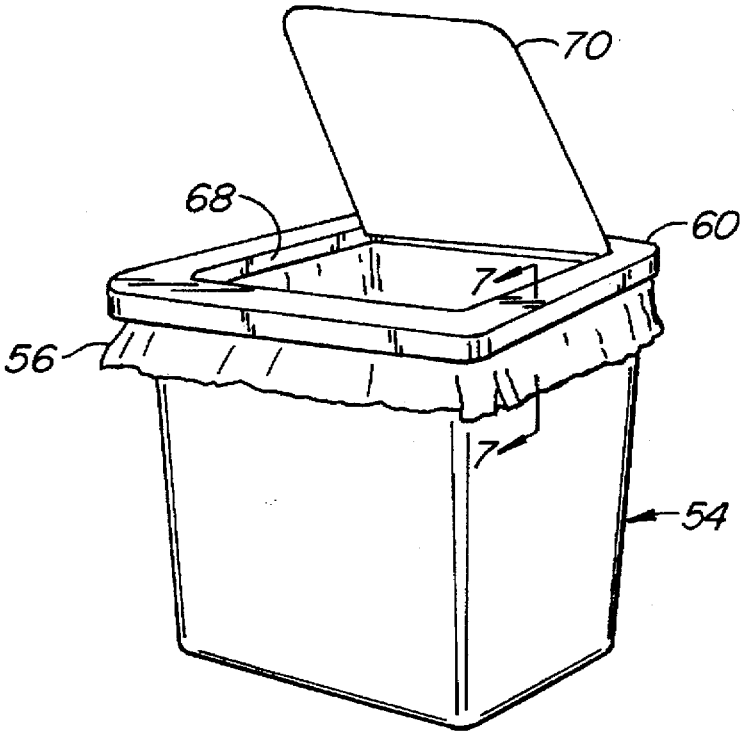
FIG. 5 is a top quarter isometric view of the inventive bag assembly within its use environment of a waste container having a bag restraining lid and a closure lid.

Pinhole-size perforations or the like are contained in both the inner and outer bags over approximately the top one-third of each bag "h," as shown in FIG. 2. The holes are randomly spaced so that they will be for the most part misaligned. The perforations may desirably be on 1½ to 2 inch centers. No holes are contained in about the bottom two-thirds of each bag, in order to retain the liquid component of waste placed in the bag assembly when it is in its receptive mode within a waste container 54 as shown in FIG. 5.

Alternatively, the holes may be distributed over the entire surface of each bag. As aforementioned, the holes may alternatively be slots or slits or any other convenient shape. Alternatively, and as also mentioned, the bag walls may be weakened, such as by making the walls thinner at a number of points. Due to air pressure buildup in the bags during compaction, holes will be formed in the walls of the bags.

Figure 7:
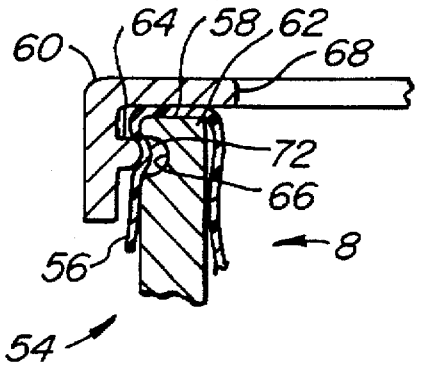
FIG. 7 is an enlarged fragmentary cross-section view of the bag assembly and container taken along lines 7—7 in FIG. 5.

With particular reference to FIG. 7, the bag assembly 8 is shown with its top edge 56 folded over the top rim 58 of container 54. A bag restraining lid 60 is fitted over the open end 62 of container 54. The lid 60 has an inner annular rim 64 which closely fits within annular groove 66 around the open end of container 56. The rim 64 and groove 66 are dimensioned so that the rim normally fits within the groove and is slightly deformed when passing over top rim 58 during installation or removal of lid 60. Lids 60 and 70, as well as container 54, may be made of a deformable plastic material such as polyethylene. In this manner, the bag assembly 8 is restrained while waste is placed therein through opening 68 in lid 60. Hinged closure lid 70 serves to selectively close off access to bag assembly 8 as best seen in FIG. 5.

Figure 6:
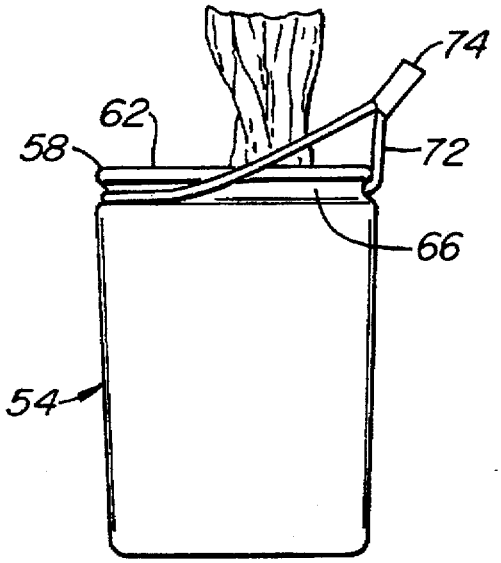
FIG. 6 is a side elevation view of the same with the restraining lid removed and the bag assembly neck gathered together positioned to receive the closing band.

As best seen in FIG. 6, a band of elastomeric material 72 such as synthetic rubber is normally stored within groove 66. When the bag assembly is full within its container 54, the bag restraining lid 60 is manually removed. The neck of the bag is gathered together as shown in FIG. 6, and a tab 74 affixed to the band is pulled to unseat the band from its accommodating groove 66. The band contracts around the neck of the bag to close it off. The tag may serve as indicia to identify the contents of the bag. For instance, the tag may be color-coded or bear visually readable text or be encoded with scannable indicia.

Alternatively, the bag assembly itself may be color-coded or bear indicia. The indicia may be of the type that is visually readable or machine readable by means of a scanner, such as bar coding or magnetic encoding.

The bag filled to its first volume is pulled from the container and placed into a compactor vehicle (not shown) for transport to a transfer station or to a landfill site. In the compactor vehicle, the bag is compacted, thereby causing at least some of the adhesive to give way and allow the bag assembly to expand to a greater volume up to the full second volume which is provided for by the folds and gussets. This second volume is illustrated by the phantom bag assembly 12' in FIGS. 2–4. The ratio of first to second volumes may conveniently be approximately 1:2, depending on the film strength of the bag material. In this manner, the bag assembly is inhibited from breaking, even though its contents are compacted.

Figure 10:
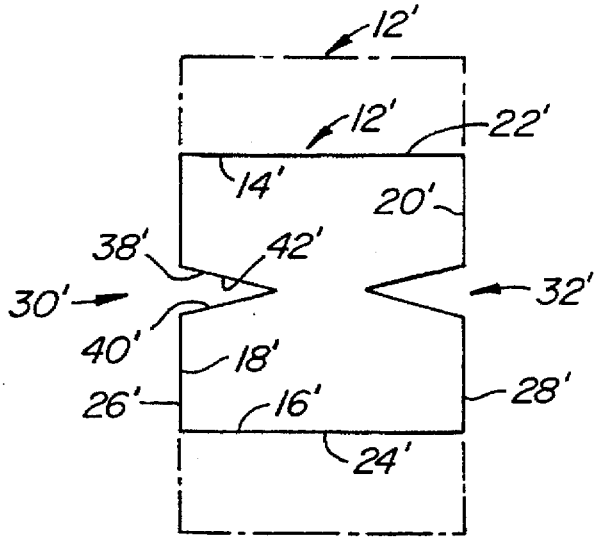
FIG. 10 is a top view of the same.
Figure 9:
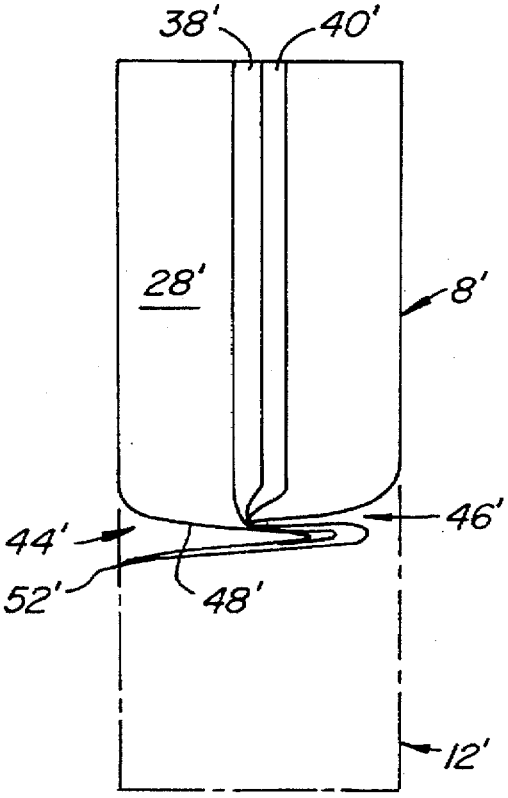
FIG. 9 is a left side elevation view of the same.
Figure 8:
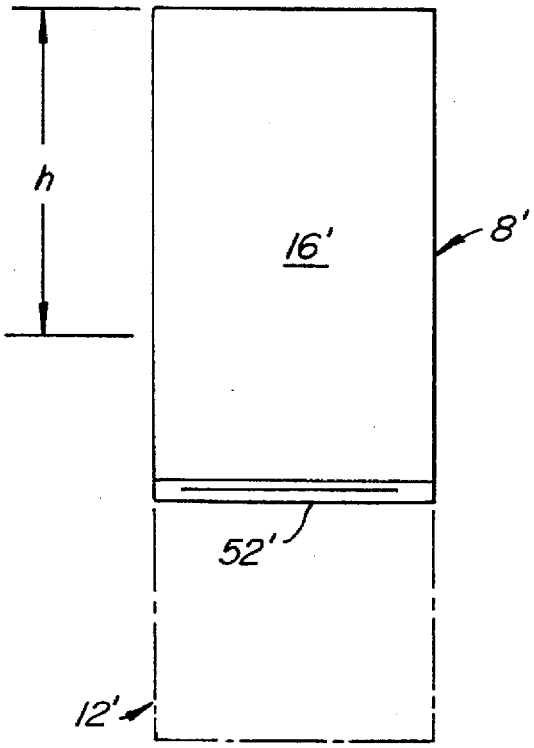
FIG. 8 is a front elevation view of an alternate embodiment of the bag assembly having a single, rather than a double, fold or gusset, with the latter expanded to show constructional features thereof.

Turning now to FIGS. 9 through 10, there is shown an alternate embodiment utilizing just a single fold or gusset. With this embodiment, constructional features having their counterpart in the previously-described preferred embodiment are marked with a prime (') to assist in comparison.

With this embodiment, a pair of gussets 30', 32' are provided. Each such gusset is comprised of a pair of gusset panels which are normally held in contacting relation. For example, gusset 30' is made up of a pair of generally rectangular gusset panels 38', 40' of outer bag 12'. Gusset panels 38', 40' are retained in their normally closed position by means of dots of adhesive, one of which is identified at 42'. As before, these are spaced over the area of contact between the gusset panels. Also as before, the bottom of the bag may be folded into a number of folds, such as the two shown at 44', 46' in FIG. 9.

In an alternate embodiment, the constraining container may be eliminated and the bag assembly supported at its open end by a frame or rack (not shown). The bag assembly could also just be hung from a hook (not shown). with this embodiment, the adhesive is sufficiently strong so that the folds or pleats will not open under the forces engendered by the filling of the bag assembly or the weight of the recyclables therein. Upon compaction, however, the bag assembly will expand to its larger volume.

In a still further alternate embodiment, a single bag rather than a double bag may be utilized, with perhaps some sacrifice in bag wall strength. With either the single or double bag, the pleats and adhesive may alternatively be eliminated. With this type of bag system, the bag assembly is constrained in its initial smaller volume by means of the surrounding container. With this embodiment, the bag assembly is dimensioned so as to be larger than the interior of the container. The bag assembly forms folds or pleats when it is positioned within the container. The container will thus define the amount of recyclables that may be placed within the bag assembly. Upon removal, the bag assembly will be expanded to a larger volume and the contents will occupy less than the larger volume.

While preferred and alternate embodiments illustrating the implementation of the invention have been disclosed, it is to be understood that the invention is not specifically limited thereto, but is to be determined by the scope of the appended claims.

What is claimed is:

1. A disposable bag assembly having a closed bottom and an open top, and a gusset, said gusset defining a pair of gusset panels joined along an edge; the disposable bag assembly further comprising retention means operatively associated with said gusset, the retention means holding the gusset in a normally closed position, said retention means having a lower yield strength than the bag material thereby allowing said bag to expand so that the gusset expands from its normally closed position without rupturing the material of said bag assembly, wherein said bag assembly comprises an inner and an outer bag, said inner bag being nested within said outer bag, and further including holes in said bags.

2. The invention of claim 1 wherein said bag assembly is dimensioned so that the bag can expand to a volume about twice as large as the bag's initial volume.

3. The invention of claim 1 wherein said holes in said bags are randomly distributed and of sufficiently small size so that a majority of holes on said inner and outer bags do not line up, thereby effectively preventing fluid from escaping through said bags.

4. The invention of claim 1, wherein the material of said bag assembly is plastic and having the property of being deformable without rupturing up to the yield point of the material.

5. The invention of claim 4 wherein said plastic material is taken from a group comprising polyethylene or polyurethane.

6. The invention of claim 1 wherein said holes are located in the top portion of said bags so as to prevent fluid within said inner bag from leaking out through said outer bag when said bag system is upright as within a waste container.

7. The invention of claim 1 wherein the bag assembly defines a plurality of bag panels forming the closed bottom and open top and wherein the panels are joined along four side edge folds to form four gusseted bag corners, the four gusseted bag corner being connected with an adhesive that has a yield strength less than the yield strength of the bag material.

8. The invention of claim 1 wherein the number of gussets is two.

9. The invention of claim 1 wherein the number of gussets is four.

10. The invention of claim 1 wherein said holes are approximately of pinhole size.

11. The invention of claim 1 wherein said holes are on approximately 1½ inch to 2 inch centers.

12. The invention of claim 1 wherein said bag assembly is dimensioned so that the second volume is at least twice the first volume.

13. The disposable bag assembly of claim 1, having a plurality of gussets.

14. A disposable bag assembly having a closed bottom and an open top, retaining means normally attached to portions of the bag material, the retention means having a lower yield strength than the bag material thereby allowing said bag to expand to second volume when the retaining means is detached from the bag material without rupturing the material of said bag assembly, said bag assembly comprising an inner and an outer bag, said inner bag being nested within said outer bag, and further including holes in said bags contained within an area that is within about one-third of the distance from the top edge of said bags so as to prevent fluid within said inner bag from leaking out through said outer bag when said bag system is upright as within a waste container.

15. A disposable bag assembly in combination with a container, the bag assembly having a closed bottom and an open top, and a gusset, said gusset defining a pair of gusset panels joined along an edge; the disposable bag assembly further comprising retention means operatively associated with said gusset, the retention means holding the gusset in a normally closed position, said retention means having a lower yield strength than the bag material thereby allowing said bag to expand so that the gusset expands from its normally closed position without rupturing the material of said bag, the container having an open top end and dimensioned to fit around said bag assembly, said container having a recess formed peripherally around said top opening, means operatively associated with said container to hold the top of said bag assembly when it is positioned over said open end, thereby keeping said bag assembly open and preventing it from moving down into said container.

16. The invention of claim 15, wherein said means operatively associated with said container to hold the top of said bag assembly comprises a band of elastomeric material in said recess.

17. A disposable bag assembly in combination with a container, the disposable bag assembly having a closed bottom and an open top, retaining means normally attaching two portions of the bag material together, the retention means having a lower yield strength than the bag material thereby allowing the the two portions of bag material to be detached from one another without rupturing the material of said bag assembly; the container having an open top end and dimensioned to fit around said bag assembly, said container having a recess formed peripherally around said top opening, means operatively associated with said container to hold the top of said bag assembly when it is positioned over said open end, thereby keeping said bag assembly open and preventing it from moving down into said container and a lid connected to the container and fitted over said open end of said bag assembly.

18. The invention of claim 17 wherein said lid comprises a bag restraining lid defining an internal annular rim, said rim being dimensioned so as to be fitted within said recess when said bag restraining lid is positioned on said container.

19. The invention of claim 18 wherein said bag restraining lid further includes a container lid for permitting access to the bag assembly.

20. A disposable bag assembly having a closed bottom and an open top, and at least one gusset, said gusset defining a pair of gusset panels joined along an edge and retention means operatively associated with said gusset, said retention means holding said gusset in a normally closed position, said bag assembly further comprising at least one fold along said closed bottom, and an additional retention means operatively associated with said fold holding said fold in a normally closed position, wherein the retention means and additional retention means have a lower yield strength than the bag material, thereby allowing said bag to expand without rupturing the material of said bag, the fold allowing for expansion of the volume of the bag in a direction toward the bottom of the bag and the gusset allowing an expansion of the volume of the bag toward the sides of the bag.

21. The invention of claim 1, 14, 15, 17 or 20 wherein said retention means is an adhesive.

22. The invention of claim 21 wherein said adhesive is a hot melt adhesive.

* * * * *